United States Patent [19]

Piazza

[11] 4,084,362

[45] Apr. 18, 1978

[54] ANCHORED COMPOSITE BUILDING MODULE

[75] Inventor: Matthew R. Piazza, Nichols, Conn.

[73] Assignee: Maso-Therm Corporation, Bridgeport, Conn.

[21] Appl. No.: 645,850

[22] Filed: Dec. 31, 1975

[51] Int. Cl.[2] ..... E04B 1/60; E04C 1/40

[52] U.S. Cl. ..... 52/309.2; 52/309.12; 52/513; 52/617; 52/705

[58] Field of Search ..... 52/705, 617, 309, 405, 52/612, 511, 513, 309.2, 309.9, 309.12

[56] References Cited

U.S. PATENT DOCUMENTS

| | | | |
|---|---|---|---|
| 2,170,165 | 8/1939 | Strong | 52/405 |
| 3,157,144 | 11/1964 | DeJarnett | 52/705 X |
| 3,247,294 | 4/1966 | Sabouni | 52/309 X |
| 3,295,278 | 1/1967 | Muhm | 52/612 |
| 3,498,001 | 3/1970 | MacDonald | 428/99 |
| 3,605,365 | 9/1971 | Hastings | 52/617 |
| 3,653,170 | 4/1972 | Sheckler | 52/565 |
| 3,709,733 | 1/1973 | Mautner | 52/617 |
| 3,742,661 | 7/1973 | Tye | 52/705 |

FOREIGN PATENT DOCUMENTS

| | | | |
|---|---|---|---|
| 851,763 | 10/1960 | United Kingdom | 264/465 |

*Primary Examiner*—Alfred C. Perham
*Attorney, Agent, or Firm*—Burgess, Dinklage & Sprung

[57] ABSTRACT

Composite building module having a rigid foam core encased in an enclosed shell made of fiber reinforced cement and an anchor device for attaching the module to a supporting structure. The anchor has an anchoring portion extending through the shell and an interlocking portion attached to the anchoring portion and extending into the foam core. The foam core is foamed within the enclosed shell filling the interior thereof and enveloping at least the interlocking portion of the anchor device.

3 Claims, 9 Drawing Figures

ANCHORED COMPOSITE BUILDING MODULE

This invention relates to a composite building module having a rigid foam core, such as a rigid urethane polymer foam, encased or encapsulated in a shell made of a hardened mixture of cement and fibers, such as glass fibers and a built-in anchor device for attaching the module to a supporting structure.

Because of increased costs in material and labor, the construction industry has come to use prefabricated building modules, for example wall panels, roof decks and the like. A popular form of construction is known as "curtain-wall" construction and involves the use of a structural steel skeleton which is faced with stacked-up, prefabricated or precast panels. Such curtain-wall panels are commonly cast from reinforced concrete and are provided with a surface finish such as a smooth concrete finish or aggregate imbedded into the face of the panels. These panels are extremely heavy, for example a 4 × 8 curtain-wall panel cast from reinforced concrete weighs from 1400–1600 lbs., and requires heavy construction equipment to install. In addition, these panels provide very poor insulating properties and by themselves are a poor vapor barrier. This necessitates further construction to insulate and seal the stacked-up curtain-wall of precast concrete modules.

The construction industry has long sought improved building elements that will offer advantages in material and construction costs.

The present invention provides a monolithic-like building module with built-in anchor devices which is extremely light in weight as compared to precast concrete panels, for example, and which has greatly improved insulating and vapor barrier properties per se. Because the present invention utilized an in situ foamed core, an adhesive interlock between the core, shell and anchor device is formed. The chemical foaming reaction that takes place, plus the fact that foaming takes place in an enclosed shell under retention, results in an overall intimate adhesive interlock and a prestressed structure wherein the shell is under tension, the core is under compression and the anchor devices are securely fixed in the shell and core. This means that the shell and core are now united together into a monolithic-like structure that has far greater strengths (because of the overall adhesive interlock) than prior laminated panels using preformed foam plastic cores, and, at the same time, is light in weight and has excellent insulating and vapor barrier properties.

SUMMARY

The composite building module of the invention comprises a rigid foam core encased in an enclosed shell made of fiber reinforced cement, anchor means for attaching the module to a supporting structure having an anchoring portion extending through the shell and interlocking portion attached to the anchoring portion and extending into the foam core, the foam core being foamed within the enclosed shell filling the interior thereof and enveloping at least the interlocking portion of the anchor means.

Preferably the anchoring portion of the anchor means extends through an aperture in the shell, which aperture decreasing in size towards the exterior of the shell thereby providing free space between the shell wall and the anchoring portion which becomes filled with rigid foam when the core is foamed in situ.

DESCRIPTION OF THE DRAWING

The present invention will be more fully understood from the following description taken in conjunction with the accompanying drawing wherein.

DESCRIPTION

Figure 1:
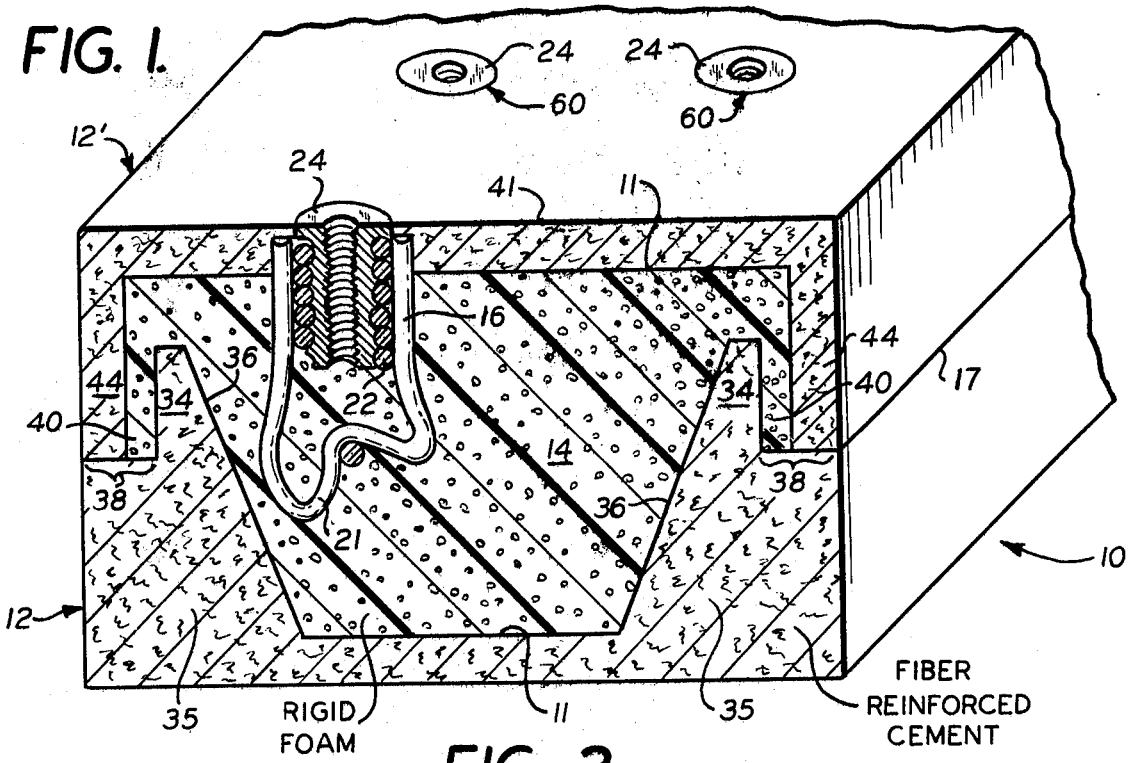
FIG. 1 is a cross-sectional view of a preferred anchored composite building module of the present invention.

Preferred hardenable mixtures for module shell are mixtures of cement, inert particulate filler and glass fibers containing 1–40% or more by volume glass fibers. Mixtures of cement and fibers with lengths of from about ⅛ to about 1 inch, or longer, can be used in the invention. Suitable fibers, in addition to glass fibers, include organic and inorganic synthetic fibers such as dacron, nylon, graphite and the like. Suitable inert particulate fillers include sand, pumice, stone dust, and the like. They can be used in amounts of from about 10 to about 30% by volume.

The cement/fiber mixtures can contain conventional additives such as lime and stearates for water resistance and latex for added strength.

Suitable rigid foams include inorganic and organic foams that can be formed in situ. Rigid urethane foams are preferred and are well-known and widely used principally for insulation purposes. Such foams are commonly created on site by combining the reactants (a polyol and an isocyanate) using airless spraying or liquid application techniques. Foaming commences almost instantaneously and is completed within a very short period of time, depending on the type of urethane composition employed but generally ranges between 1.5 lbs. per cu. ft., more commonly from 2 to 5 lbs. per cu. ft. Other suitable rigid foams include polyester foams, phenolic resin foams, isocyanurate foams, and the like.

The present invention combines a hardenable mixture of cement and fibers with rigid foams and provides a surprisingly strong and self-supporting anchored building module which is light in weight and has outstanding insulating and vapor barrier properties.

The invention will now be described with reference to the drawing and the preferred embodiment of a rigid urethane foam polymer core and a cement/glass fiber shell.

FIG. 1 of the drawing shows a preferred building module in cross-section having a rigid urethane polymer foam core 14 encased in a shell having a bottom half 12 and upper or top half 12' each made of a mixture of cement and glass fibers. Anchor devices 60 are embeded in the shell and core 14. The finished panel or module is indicated generally by the reference numeral 10. The bottom half 12 has a peripheral ledge 38 and the rib 34 are integrally formed and together make up the side wall of the bottom half 12 having the stepped configuration shown and indicated generally by the reference numeral.

The top half of the shell 12' has side walls 44 which are less thick than the width of the ledge 38. This means that when the top shell 12' is placed on the bottom shell half 12 the side walls 44 of the top half 12' rest on the ledge 38 creating an edge seam 16 and, within the interior of the shell the side walls 44 form with the rib 34 a channel 40. In the embodiment shown in FIG. 1, the channel 40 is actually formed by rib 34, ledge 38 and side wall 44 of the top shell half 12'. As shown in FIG. 1c, the rib 34 can extend up from the bottom 31 of the shell half 12 which means that the corresponding channel will be larger in size.

The configuration shown on FIG. 1 is preferred because the stepped configuration 35 provides additional bulk at the edge of the panel and when two panels are assembled and joined in an edge-to-edge assembly, a load-bearing column results.

Figure 2:
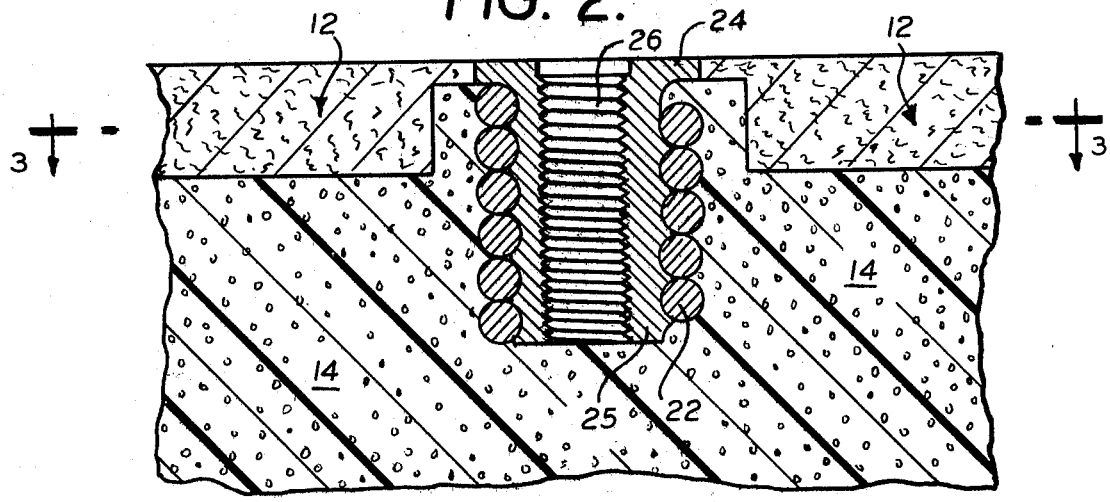
FIG. 2 is a cross-sectional view partly broken away showing the anchored portion of a composite building module on an enlarged scale.

The anchor device 60 has an anchoring portion made of a spring like coil 22 into which is threaded member 25 having a threaded bore 26 and a flanged head 24 (FIG. 2). The head 24 is adapted to fit into a corresponding aperature in the shell and sit flush with the outside surface of the shell (FIG. 5, 1 and 2) leg members 16 are bonded (e.g. by welding) to coil portion 22 and form the interlocking portion which becomes enclosed and completely surrounded by the foam core 14 in the course of the in situ foaming operation.

Figure 3:
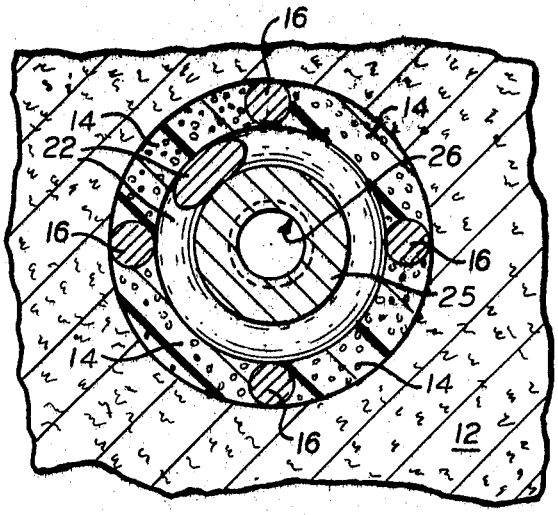
FIG. 3 is a cross-sectional view taken along line 3—3 of FIG. 2.
Figure 4A:
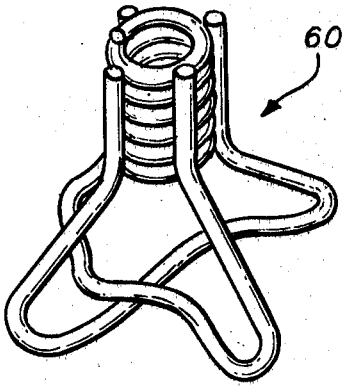
Figure 4B:
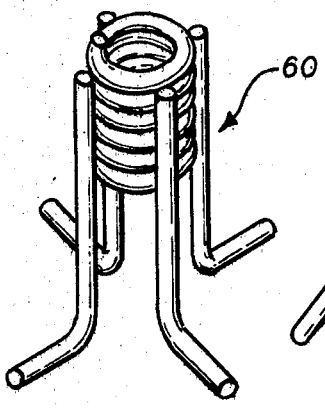
Figure 4C:
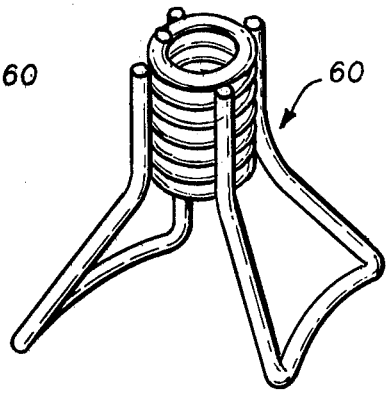
Figure 4D:
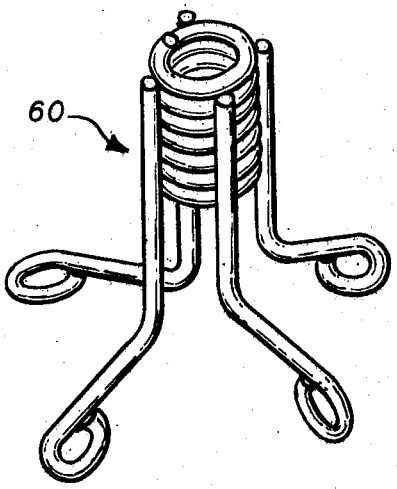
Figure 4E:
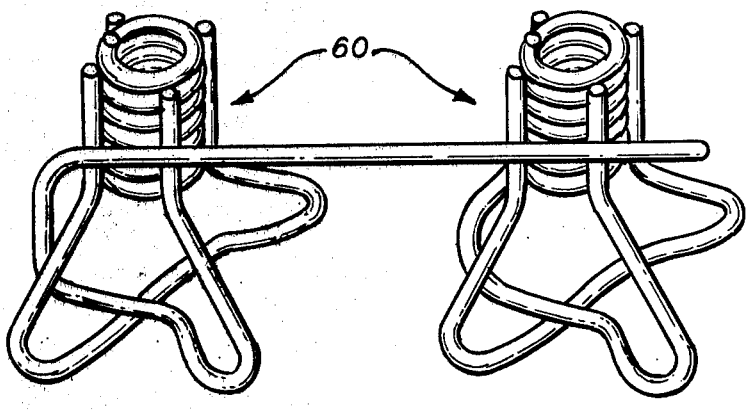

In a preferred embodiment, the aperature in the shell wall decreases in size towards the shell exterior (FIG. 2) which forms a free space between the shell wall and the anchoring portion 22, 25 which becomes filled with rigid foam 14 at the time the core is foamed in situ. (FIGS. 2 and 3) Thus the aperature in the shell has a stepped (FIG. 2) or tapered configuration so that rigid foam 14 can enter the free space created by this configuration and adhesively interlock with a substantial portion of the anchoring portion 22, 25 of the device 60 as well as the legs 16 and the interior of the shell in the in situ foaming operation.

The threaded bore 26 will accept conventional threaded male anchoring devices which enables the anchored panels of the invention to be handled, transported, installed and secured in place in the same fashion as solid precast concrete panels, without, however, the weight involved with such panels.

FIG. 4*a–e* show varying configurations for the anchoring devices 60 and in particular the interlock portions. The particular configuration of the interlocking portion is not critical so long as it contains sufficient bends and angles to interlock and bond with the foam core 14.

Figure 5:
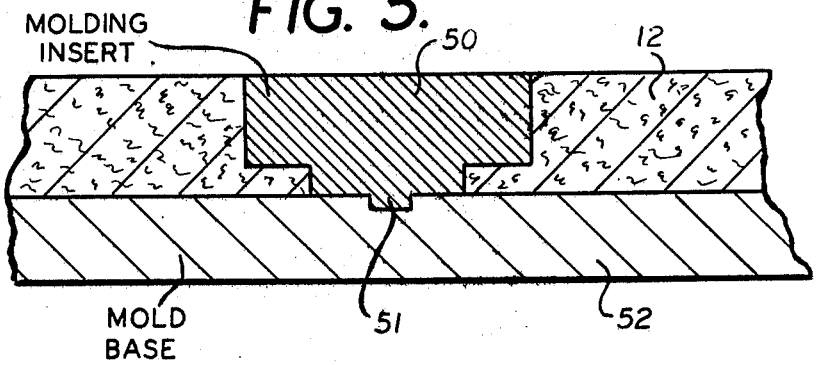
FIG. 5.4*a–e* show suitable anchor devices for use in the invention.

FIG. 5 shows a preferred method of forming aperatures in the shell 12 using a molding insert 50 with a key portion 51 which fits into a mold base as to preposition the anchor devices 60.

The rib 34 preferably has a sloped wall 36 as shown in FIG. 1 to facilitate mold removal and again to provide additional bulk at the edges of the panel. The rib 3 preferably is a continuous rib extending around the entire periphery of the interior of the panel shell but it can be discontinuous or interrupted depending on the intended use of the panel.

The rigid urethane foam core 14 is formed within the enclosed shell formed by shell halves 12 and 12' and fills the interior of the panel shell including the channel 40 formed by the side walls 44 of the top shell half 12' and the rib member 34 of the bottom shell half 12 as well as the free space surrounding the members 22, 25 of the devices 60.

The encapsulation of the rigid foam core 14 by the shell halves 12 and 12' results in the formation of intimate adhesive bond 11 between the core 14 and the shell halves 12 and 12' over the entire surface area of the core 14. Because the rigid foam core 14 is formed in situ, the foaming urethane polymer enters and fills surface irregularities the channel 40 and the free space surrounding members 22, 25 of the device to provide an intimate overall rigid interfacial adhesive interlock between the rigid foam core 14 the shell halves 12 and 12' and the anchoring device 60. The channel 40 provides additional surfaces area within the interior of the panel shell and in effect increases the interfacial adhesive interlock in the important area of the edge seam 16 where the two shell halves 12 and 12' come together.

Finished modules can be joined in an edge-to-edge assembly whereby the joined edges form a load-bearing column. The finished modules can be conviently joined using an elastomeric material which forms a joint between adjacent panels. Other types of bonding materials conventionally used to join together prefabricated panels can also be employed within the context of the present invention.

Depending on the intended use of the modules of the invention, the side walls 44 and the flat portion 41 of the shell half 12' and the flat portion of the shell portion have thicknesses in the range of from about $\frac{1}{8}$ inch to about 1 inch or more. If desired, this thickness can be greater or less. For curtain-wall construction, thicknesses in the range of from $\frac{1}{4}$ inch to $\frac{3}{8}$ inch are preferable.

In a preferred embodiment, the side walls 44 and the flat portion 41 of the shell half 12' are $\frac{3}{8}$ inch thick. The same thickness is employed for the flat portion of the bottom shell half 12. The width of the ledge 38 is $\frac{3}{8}$ inch and the rib 34 extends 1 inch above the ledge 38. The top of the rib 34 is $\frac{1}{4}$ inch thick and the channel 40 is $\frac{1}{4}$ inch wide. This means that the stepped portion 35 of the bottom shell half 12 is approximately $\frac{7}{8}$ of an inch from the edge of the shell. When two panels are joined in edge-to-edge assembly, this means that there is approximately 2 inches of glass reinforced cement extending across the joined edges of two panels and this assembly together with the side walls 44 of the top shell halves 12' and the formed in place core 14 forms a load-bearing column.

The rigid foam core 14 can range in thickness from about 1 in. to 10 in. or more and this can be greater or less depending on the structure involved and the intended use. The building modules themselves can be made in almost any size ranging from small modular units up to large curtain wall units or roof deck members.

There are many ways in which the building module of the invention can be employed. Because building modules of the invention are like monolithic modules in outward appearance and use, yet self-insulating, the modules of the invention can be used in the same fashion using the same construction and installation techniques as monolithic concrete modules. Thus, the composite module 10 can be used as a wall panel or roof deck member. The wall panels can be provided with window openings or door openings. The modules can also be used as interior partition wall panels as well as other numerous uses. Because of the light weight of the module of the invention, great savings can be realized in the load bearing structure of buildings. Thus, for example, in a multistory, curtain-wall building, considerably less structural steel will be needed to support the exterior panels as compared to the structural steel required to support precast concrete panels.

The facing surfaces of the composite panel 10 can be provided with any finish, texture or design which can be imparted via the finish or design of the mold surfaces or by imbedding or adhering aggregate such as gravel, broken stone, marble chips and the like to one or more surfaces of the shell 12. It is also possible to incorporate aggregate such as sand, gravel, broken stone and marble chips into the mixture of cement and glass fibers before forming the shell 12 for increased strength and also to attain desired surface textures or finishes.

The composite building module in FIG. 1 can be made by forming shell halves 12 and 12' using forms or molds with inserts 60 to define the face, the side and end walls and the interior of the bottom shell 12. A trowelable mixture of cement and glass fibers can be applied by hand to the interior surfaces of the forms or molds to build up the shells 12 and 12' to the desired thickness. Anchors 60 are inserted after curing.

To form core 14 in situ a flowable foamable rigid urethane polymer composition is introduced into the bottom half shell 12 and then the top shell half 12' is put in place as shown in FIG. 1a. The shell 12' is placed before the polymer begins to foam, or foaming fills the shell, and the shell halves are supported and held in place while the polymer composition foams in the completely encased interior of the shell thereby filling same including channel 40 and providing an overall rigid interfacial adhesive interlocked between the rigid foam core 14 and the interior of the shell. As is known, a liquid or flowable urethane polymer composition exerts an outward pressure when caused to foam within a confined space such as the shell and this can be used to advantage to ensure and promote an intimate overall rigid interfacial interlock between the entire exterior surface area of the rigid foam core 14 and the entire interior surface area of the shell especially in channel 40 and the anchor 60.

A preferred method for making the composite building modules will now be described. At a first station, metal or glass fiber/polyester molds, preferably with fold down ends to facilitate product removal, in the form of shell tops 12' and bottoms 12 have applied thereto a mixture of cement and glass fiber preferably containing 35–40% by volume glass fiber. The mixture of cement and glass fiber can be premixed dry and water subsequently added to provide a viscous mixture. This mixture can then be sprayed into the mold interiors or applied by hand.

In the preferred embodiment, hot wet cement (made with water at about 120–200° F., e.g., 180° F) with glass fiber is applied to or sprayed into the interior of the molds. The molds can then be vibrated to obtain uniform distribution of the glass throughout the entire volume of the cement and complete filling of the molds. Following this, or at the same time, the mixture of glass fiber and cement in the molds can be pressed with a forming member to distribute the cement/glass fiber mixture within the interior of the molds. Also, if desired, suction can be applied to the mold walls to remove water.

At the same time the glass is chopped and sprayed, a coating can be applied thereto by spraying, for example, with a polyester in a water miscible solvent such as alcohol, to impart alkali resistance to the fibers.

The molds are then fed to a curing line. If hot cement is used, oven curing can be eliminated. Oven curing generally requires about 6 hours to produce a hardened shell for the glass fiber reinforced cement tops and bottoms, curing time for hot cement is generally 50% less.

Next, flowable, foamable rigid urethane polymer composition is poured into the open shell half 12 and the top half 12' is then set in place before substantial foaming begins. The assembly is then held under pressure while the urethane polymer foams and sets. This can be accomplished using a hydraulic press or other restraint device.

After the urethane polymer foam sets, filling the shell and providing an overall rigid interfacial adhesive interlock between the rigid foam core and the interior of the shell, the panel is removed from the restraint device.

The composite panel is now ready for use or can have a surface finish applied. Preferably, the surfaces of the panel have applied thereto a sealer, such as a polyester type of sealer. While the panel itself is substantially water proof, the application of a sealer insures that the panel will maintain its water proofness. If desired, in addition to or in place of a sealer, the panel can be painted, stained or other types of coatings can be applied, for example, to provide for easy removal of graffiti. It has also been found that a sealer, when applied in a thick coating, can also be used to adhere aggregate to a surface of the panel to provide a surface finish.

Many modifications can be made in the composite building modules of the invention without departing from the spirit and scope hereof. For example, the rigid foam core 14 can be reinforced utilizing woven or nonwoven screen and mesh layers made of synthetic fibers or metals and prestressing techniques can be employed if desired. As mentioned previously, one or more exterior surfaces of the shell can be provided with any desired finish, texture or design or can be embedded with inorganic aggregates such as gravel, broken stone, marble chips and the like. As for surface design and texture, the exterior of the shell will conform to the finish of the mold surface to achieve desired effects, for example, a wood grain appearance and the like. The shell can also be formed with molded-in mounting or building clips and/or grooves.

As mentioned previously, the composite building module of the invention can be used and installed in the same manner as conventional building modules such as curtain-wall panels but with a great reduction in weight (and simplified installation procedures). Because of the greatly improved insulating and water vapor barrier properties of the modules of the invention, no further steps have to be taken to ensure these properties as is the case with conventional building modules.

In roof deck installations or curtain-wall installation, a room temperature curing elastomer such as a silicone elastomer can be used for edge-to-edge bonding between adjacent modules and the entire installation can be provided with an overcoating of a suitable elastomer. This provides for a shock resistant installation which can also compensate for later movement of a structure, for example, as a building settles after construction.

In addition to the uses mentioned previously, the composite module in the invention can be formed into insulated pipes and conduits, railroad ties, modular walls and even loads bearing modular panels which can incorporate conduits for utilities, window frames, door frames and the like. It should also be noted that the composite building panel of the invention is buoyant because of the rigid foam core 14 which property can be utilized to advantage in the construction of floating docks and wharfs as well as offshore drilling platforms.

Foamable urethane compositions forming rigid urethane polymer foams are commercially available in a wide range of chemical and physical properties. Such compositions generally contain an isocyanate component containing reactive isocyanate groups, a polyol component containing one or more polyols, catalytic agents and preferably a flame or fire resistant agent such as trichloromonofluoro methane. Typical properties of rigid urethane polymer foams available commercially are set forth in the following table:

TYPICAL RIGID URETHANE FOAM PROPERTIES

| Density lb./cu ft. Astm D 1622 | Compressive Strength psi Astm D 1621 | Compressive Modulus psi Astm D 1621 | Shear Strength psi | Shear Modulus psi |
|---|---|---|---|---|
| 1.5-2.0 | 20-60 | 400-2000 | 20-50 | 250-550 |
| 2.1-30 | 35-95 | 800-3500 | 30-70 | 350-800 |
| 3.1-45 | 50-185 | 1500-6000 | 45-125 | 500-1300 |
| 4.6-70 | 100-350 | 3800-12,000 | 75-180 | 850-2000 |
| 7.1-10.0 | 200-600 | 5000-20,000 | 125-275 | 1300-3000 |

What is claimed is:

1. Composite building module comprising a rigid foam core encased in an enclosed shell made of fiber reinforced cement having at least one aperture therethrough and at least one anchor means each extending through only one wall through one aperture for attaching said module to a supporting structure having an anchoring portion extending through the aperture in said one wall of said shell and an interlocking portion having an attaching portion attached to the anchoring portion along the length thereof and an extending portion extending radially outwardly from the periphery of the anchoring portion and into said foam core, wherein each aperture decreases in size towards the exterior of the shell to closely receive only the anchoring portion at the exterior of the shell and to provide a clearance between the remaining shell wall and anchoring portion to receive the anchoring portion and the attaching portion of the interlocking portion, said foam core being formed within the enclosed shell filling the interior thereof and enveloping at least the interlocking portion of the anchor means and coacting with the interlocking portion in conjunction with the blocking effected by the decreased aperture size at the exterior of the shell to resist removal of the anchor means in response to an outwardly directed force thereon.

2. Composite module of claim 1 wherein the shell has a bottom half and a top half, said bottom half having a peripheral ledge and inwardly adjacent thereto a rib member extending above the level of said ledge, said top half having side walls forming a channel with said rib when the top half of the shell is in place on the bottom half, said foam core filling said channel.

3. Composite module of claim 1 wherein the anchoring portion has an internally threaded member and the interlocking portion has one or more closed loops attached to said threaded member.

* * * * *

UNITED STATES PATENT AND TRADEMARK OFFICE

CERTIFICATE OF CORRECTION

PATENT NO. : 4,084,362

DATED : April 18, 1978

INVENTOR(S) : Matthew R. Piazza

It is certified that error appears in the above-identified patent and that said Letters Patent are hereby corrected as shown below:

Column 4, line 37 "3/8" should be -- 5/8 --

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*